US011059197B2

(12) United States Patent
King et al.

(10) Patent No.: US 11,059,197 B2
(45) Date of Patent: Jul. 13, 2021

(54) METHOD OF SLICING A FOOD ITEM AND SLICING MECHANISM EMPLOYING A GRIPPING ELEMENT THAT GENERATES A VACUUM GRIP

(71) Applicant: Cozzini LLC, Chicago, IL (US)

(72) Inventors: Edwin Earl King, Lombard, IL (US); Frank Edmund Witkowski, Frankfort, IL (US)

(73) Assignee: COZZINI LLC, Chicago, IL (US)

( * ) Notice: Subject to any disclaimer, the term of this patent is extended or adjusted under 35 U.S.C. 154(b) by 0 days.

(21) Appl. No.: 16/011,089

(22) Filed: Jun. 18, 2018

(65) Prior Publication Data

US 2019/0061194 A1 Feb. 28, 2019

Related U.S. Application Data

(60) Provisional application No. 62/549,759, filed on Aug. 24, 2017.

(51) Int. Cl.

| | |
|---|---|
| ***B26D 7/01*** | (2006.01) |
| ***B26D 7/06*** | (2006.01) |
| ***B26D 3/28*** | (2006.01) |

(52) U.S. Cl.

CPC ..... *B26D 7/018* (2013.01); *B26D 3/28* (2013.01); *B26D 7/0608* (2013.01); *B26D 2210/02* (2013.01)

(58) Field of Classification Search

CPC .. B26D 2210/02; B26D 7/018; B26D 7/0608; B26D 7/0616; B26D 2007/011; B25B 11/005

See application file for complete search history.

(56) References Cited

U.S. PATENT DOCUMENTS 2,007,219 A 7/1935 Singer
2,198,765 A * 4/1940 Featherstone ..... B25B 11/005 451/388

(Continued)

FOREIGN PATENT DOCUMENTS

DE 3909639 A1 * 9/1990 ..... B26D 7/01
DE 100 24 913 A1 11/2001

(Continued)

OTHER PUBLICATIONS

International Search Report (4 pages) dated Oct. 30, 2018 from corresponding PCT Application No. PCT/US2018/038193.

(Continued)

*Primary Examiner* — Jennifer S Matthews
(74) *Attorney, Agent, or Firm* — Barnes & Thornburg LLP

(57) ABSTRACT

A method of processing a food item that includes moving a food item along a direction towards an automated slicer, wherein prior to the food item being sliced by the automated slicer the food item that is being moved has a length, L, as measured along the direction. The method further includes determining a thickness, T, of a slice of the food item to be generated by the automated slicer and slicing the food item that has the length, L, by the automated slicer so that a maximum possible number, $N_{max}$, of slices of the food item are generated that have the thickness, T.

24 Claims, 16 Drawing Sheets

(56) References Cited

U.S. PATENT DOCUMENTS

| | | | | | |
|---|---|---|---|---|---|
| 3,797,343 | A * | 3/1974 | Miller | B26D 7/018 | 83/80 |
| 3,880,295 | A * | 4/1975 | Wyslotsky | B25B 11/005 | 414/18 |
| 4,321,847 | A | 3/1982 | Dillon | | |
| 4,428,263 | A * | 1/1984 | Lindee | B26D 7/018 | 83/354 |
| 4,479,435 | A * | 10/1984 | Takeuchi | B25B 11/005 | 101/389.1 |
| 5,048,804 | A * | 9/1991 | Ito | B25B 11/005 | 269/21 |
| 5,051,268 | A | 9/1991 | Mally | | |
| 5,436,693 | A * | 7/1995 | Marumo | B25B 11/005 | 269/21 |
| 6,051,067 | A * | 4/2000 | Mou | B25B 11/005 | 118/500 |
| 6,418,823 | B1 | 7/2002 | Taitler | | |
| 8,616,602 | B2 | 12/2013 | Hukelmann et al. | | |
| 8,892,239 | B2 | 11/2014 | Weber | | |
| 9,132,563 | B2 | 9/2015 | Reifenhaeuser | | |
| 9,132,564 | B2 | 9/2015 | Reifenhaeuser | | |
| 9,375,859 | B2 | 6/2016 | Weber | | |
| 2005/0034576 | A1 | 2/2005 | Ray et al. | | |
| 2005/0040577 | A1* | 2/2005 | Fong | B25B 11/005 | 269/21 |
| 2010/0050834 | A1* | 3/2010 | Reifenhauser | B26D 7/018 | 83/13 |
| 2012/0089244 | A1 | 4/2012 | Weber | | |
| 2013/0139665 | A1* | 6/2013 | Sperry | B26D 7/32 | 83/77 |
| 2014/0082926 | A1 | 3/2014 | Tam | | |
| 2014/0144303 | A1 | 5/2014 | Muller | | |
| 2015/0190939 | A1* | 7/2015 | Gerlach | B26D 7/06 | 83/13 |
| 2016/0339597 | A1 | 11/2016 | Lischinski et al. | | |
| 2018/0222074 | A1* | 8/2018 | Baumeister | B25J 15/0616 | |

FOREIGN PATENT DOCUMENTS

| | | | | |
|---|---|---|---|---|
| DE | 102011012880 | A1 * | 4/2012 | B26D 7/018 |
| EP | 1 400 324 | A1 | 3/2004 | |
| EP | 2439029 | A1 * | 4/2012 | B26D 7/0683 |
| JP | 2002-200590 | A | 7/2002 | |

OTHER PUBLICATIONS

Written Opinion PCT/US2018/038193 (12 pages) from corresponding PCT Application No. PCT/US2018/038193.

U.S. Appl. No. 16/747,853, filed Jan. 21, 2020, King et al.

Extended Search Report issued in Appl. No. EP18848836.5 (dated Apr. 13, 2021).

* cited by examiner

PRIOR ART

PRIOR ART

METHOD OF SLICING A FOOD ITEM AND SLICING MECHANISM EMPLOYING A GRIPPING ELEMENT THAT GENERATES A VACUUM GRIP

This application claims the benefit of priority under 35 U.S.C. § 119(e)(1) of U.S. Provisional Application Ser. No. 62/549,759, filed Aug. 24, 2017, the entire contents of which are incorporated herein by reference.

FIELD OF THE INVENTION

The present invention is directed to a method of slicing an item, such as a food item, and a slicing mechanism for slicing an item, such as a food item

BACKGROUND OF THE INVENTION

An item to be sliced, such as a food item 10, is shown in FIG. 1. If the food item 10 is to be sold in a sliced condition, it is often desired that each slice 12 has an identical thickness, T. So, for a given length, L, of the food item 10, the maximum number, $N_{max}$, of desired slices that can be generated from the food item 10 is equal to the equation $N_{max}=[L/T]T$. It is obvious that it is desirable to produce $N_{max}$ slices for each food item in order to maximize efficiency in the use of the sliced food item. For example, if the sliced food item was to be commercially sold, achieving $N_{max}$ slices for the sliced food item means less waste in the process. Note that the symbol $[\ ]_T$ represents a truncation function that is performed on the decimal representation of the ratio L/T so that all digits to the right of the decimal point are eliminated/removed. For example, $[6/1.7]_T=[3.529\ldots]_T=3$. The digits to the right of the decimal point represent the fraction of a slice left after slicing is completed.

Note that the shapes of the food item 10 drawn and shown in FIG. 1 and FIGS. 2-4 are for illustrative purposes only and should not be taken as an admission that such shapes were previously known or previously used with slicers.

With the above description in mind, a discussion of a known slicing process will now be presented. As shown in FIG. 2, a conventional food slicer includes a rotating blade 20 that is fixed in position. A pushing plate 22 translationally moves towards the rotating blade 20 as denoted by the arrow in FIG. 2. A food item 10 is positioned on a support surface 24 between the rotating blade 20 and the pushing plate 22. The pushing plate 22 is pushed toward the food item 10, contacts, and then pushes the food item 10 towards the rotating blade 20, as shown in FIG. 3. Pushing continues until the rotating blade 20 cuts the food item 10 into slices. Due to the irregular shape of the portion of food item 10 that is nearest the pushing plate 22, it may be difficult to maintain the stability of the food item 10 as it nears the rotating blade 20 so that one or more slices of the food item 10 of a desired thickness T cannot be generated. The irregular shape results in the total number of slices generated being smaller than desired. Thus, unwanted waste can occur.

In the case of most known high-speed slicers, they use either grippers or continuous feed systems of various types to hold and advance product while slicing. In such slicers that use grippers, there is always an end piece that does not get sliced or is not sliced at the desired thickness T.

In the case of continuous feed systems, they lose control at some point and the end piece falls through the knife or gets sliced to an unpredictable thickness. In such a scenario, the end piece or slices must be separated from good slices and, thus, lowers the product slice yield.

In the case of gripper systems, they always have a small piece that is not sliced and can lower product slice yield. Such a gripper system is schematically shown in FIG. 4 and includes a rotating blade 20 that is fixed in position. The gripper 30 has one or more appendages 32 that grip/engage a portion of the food item 10 that is nearest the gripper 30. The gripper 30 pushes the food item 10 toward the rotating blade 20 as denoted by the arrows shown in FIG. 4. Pushing continues until the rotating blade 20 approaches close to the appendages 32 at which point slicing is discontinued. At this point in the process, the gripper 30 holds a portion of the food item 10 that may be of a sufficient size to be theoretically sliced by blade 20 into one or more slices having the desired thickness, T. Thus, the gripper 30 prevents the blade 20 from cutting the maximum number, $N_{max}$, of desired slices that can be generated from the food item 10.

It should be pointed out that under certain circumstances, the above described gripper system is able to cut the maximum number, $N_{max}$, of desired slices that can be generated from the food item 10. This occurs when the food item has a tapered end, such as shown with the shape of food item 10 shown in FIG. 1. When the end is tapered, the appendages 32 are able to grip the food item 10 close to the end of the tapered end such that there is room between the appendages 32 and the front end of the food item so that the maximum number, $N_{max}$, of desired slices can be achieved.

In the case where food item 10 has an irregular shape that fails to have a tapered portion for engagement by the appendages 32, then there is no guarantee that the maximum number, $N_{max}$, of desired slices can be achieved.

It is an objective of the present invention to increase the yield of slices generated from food items having various shapes, such as: 1) an irregular shape, 2) a regular shape that does not have enough undesired product to grip, 3) a food item with a naturally occurring flat surface, or 4) a food item that has been altered to have a flat surface.

SUMMARY OF THE INVENTION

One aspect of the present invention regards a method of slicing a food item that includes slicing through the food item only once so that a first portion of the food item and a second portion of the food item are formed and are separate from one another, wherein the first portion has a first flat face where the food item was sliced due to the slicing and the second portion has a second flat face where the food item was sliced due to the slicing. The method further includes positioning the first portion between an automated slicer and a surface of a pressing device so that the first flat face faces the surface and moving the surface so as to approach the automated slicer, wherein during the moving the first flat face engages the surface and the first portion is sliced by the automated slicer.

A second aspect of the present invention regards a method of slicing a food item that includes positioning a food item, including only a single flat face generated by slicing the food item, between an automated slicer and a surface of a pressing device so that the first flat face faces the surface. The method further includes moving the surface so as to approach the automated slicer, wherein during the moving the first flat face engages the surface and the first portion is sliced by the automated slicer.

A third aspect of the present invention regards a method of processing a food item that includes moving a food item along a direction towards an automated slicer, wherein prior to the food item being sliced by the automated slicer the food item that is being moved has a length, L, as measured along the direction. The method further includes determining a thickness, T, of a slice of the food item to be generated by the automated slicer and slicing the food item that has the length, L, by the automated slicer so that a maximum possible number, $N_{max}$, of slices of the food item are generated that have the thickness, T.

A fourth aspect of the present invention regards a vacuum support including a housing defining an interior chamber, wherein the housing includes an exterior surface that defines a first opening and a second opening. A first valve is positioned within the first opening and movable from a first position wherein the first opening is closed to a second position wherein the first opening is open. The vacuum support includes a second valve positioned within the second opening and movable from a third position wherein the second opening is closed to a fourth position wherein the second opening is open. A vacuum source is in fluid communication with the interior chamber so that an interior pressure is formed within the interior chamber that is less than an air pressure that exists exterior to the housing. The first valve has a structure such that when exposed to the interior pressure the first valve is biased to the first position.

A fifth aspect of the present invention regards a slicing mechanism that includes a rotating blade, a support surface, and a vacuum support that engages the support surface so as to translationally move toward the rotating blade. The vacuum support includes a housing defining an interior chamber, wherein the housing includes an exterior surface that defines a first opening and a second opening. The vacuum support further includes a first valve positioned within the first opening and movable from a first position wherein the first opening is closed to a second position wherein the first opening is open. The vacuum support includes a second valve positioned within the second opening and movable from a third position wherein the second opening is closed to a fourth position wherein the second opening is open. A vacuum source is in fluid communication with the interior chamber so that an interior pressure is formed within the interior chamber that is less than an air pressure that exists exterior to the housing. The first valve has a structure such that when exposed to the interior pressure the first valve is biased to the first position.

A sixth aspect of the present invention regards a slicing system that includes a slicing mechanism that has a rotating blade, a support surface, and a vacuum support that engages the support surface so as to translationally move toward the rotating blade. The vacuum support includes a housing defining an interior chamber, wherein the housing includes an exterior surface that defines a first opening and a second opening. A first valve is positioned within the first opening and movable from a first position wherein the first opening is closed to a second position wherein the first opening is open. A second valve is positioned within the second opening and movable from a third position wherein the second opening is closed to a fourth position wherein the second opening is open. A vacuum source is in fluid communication with the interior chamber so that an interior pressure is formed within the interior chamber that is less than an air pressure that exists exterior to the housing. The slicing system further includes an item to be sliced by the rotating blade, the item positioned between the rotating blade and the exterior surface such that the item engages both the first valve so as to be at the second position and the second valve so as to be at the fourth position which causes the item to be subject to a negative pressure and engage the exterior surface.

A seventh aspect of the present invention regards a method of slicing an item that includes positioning an item between a rotating blade and an exterior surface and moving the exterior surface toward the item so as to make contact with the item. The contact causes multiple valves of the exterior surface to move to an open position that results in the item being subjected to a negative pressure via the multiple valves. The method further includes moving the exterior surface toward the rotating blade so that the rotating blade generates slices of the item.

An eighth aspect of the present invention regards a vacuum support including, a housing defining an interior chamber, wherein the housing has an exterior surface that defines a plurality of openings, each opening having a predetermined size and in fluid communication with the interior chamber. A vacuum source is in fluid communication with the interior chamber so that a predetermined interior pressure is formed within the interior chamber that is less than an air pressure that exists exterior to the housing. The predetermined size is such that when at least a predetermined percentage of the plurality of openings are blocked the predetermined interior pressure is still formed by the vacuum source.

A ninth aspect of the present invention regards a slicing mechanism including a rotating blade, a support surface, and a vacuum support that engages the support surface so as to translationally move toward the rotating blade. The vacuum support includes a housing defining an interior chamber, wherein the housing has an exterior surface that defines a plurality of openings, each opening having a predetermined size and in fluid communication with the interior chamber. The vacuum support further includes a vacuum source that is in fluid communication with the interior chamber so that a predetermined interior pressure is formed within the interior chamber that is less than an air pressure that exists exterior to the housing. The predetermined size is such that when at least a predetermined percentage of the plurality of openings are blocked the predetermined interior pressure is still formed by the vacuum source.

One or more aspects of the present invention provide the advantage of increasing the yield of slices generated from a food item that is processed by a slicing mechanism.

BRIEF DESCRIPTION OF THE DRAWINGS

The various features, advantages and other uses of the present apparatus will become more apparent by referring to the following detailed description and drawing in which.

DETAILED DESCRIPTION

As shown in the exemplary drawing figures, a slicing system is shown, wherein like elements are denoted by like numerals.

FIGS. 5-8 and 16A-B show an embodiment of a slicing system 200 that includes a slicing mechanism 202 and an item 204 to be sliced by the slicing mechanism 202. The item 204 preferably is a food product, such as a meat product or a bread product. Of course, the slicing of other types of items are within the scope of the present invention.

Figure 1:
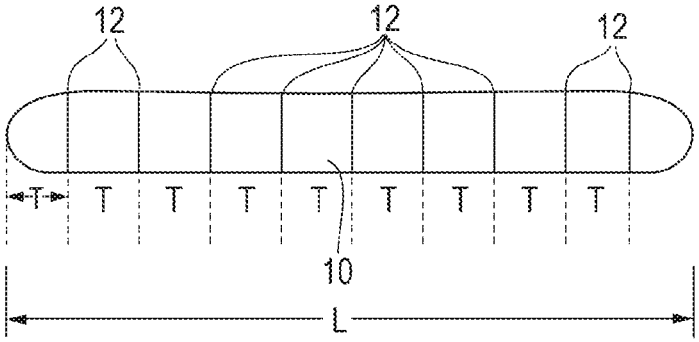
FIG. 1 is a schematic view demonstrating a prior known manner of slicing a food item.
Figure 2:
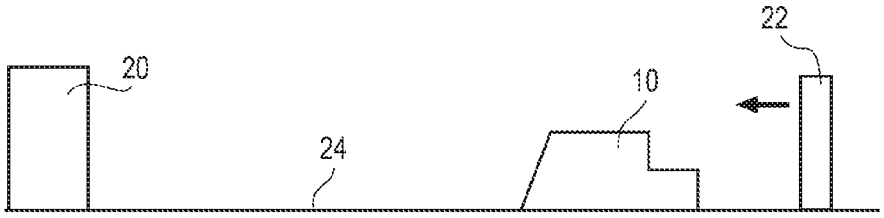
FIG. 2 is a schematic side view of an embodiment of a first phase of a known method of slicing a food item.
Figure 3:
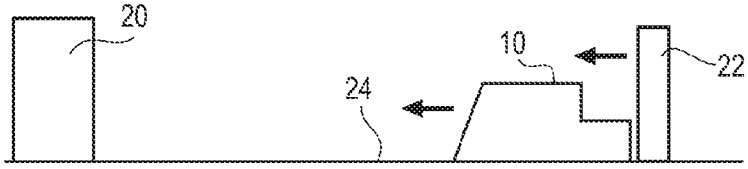
PRIOR ART Fig. 3
FIG. 3 is a schematic side view of an embodiment of a second phase of the known method of slicing a food item.
Figure 4:
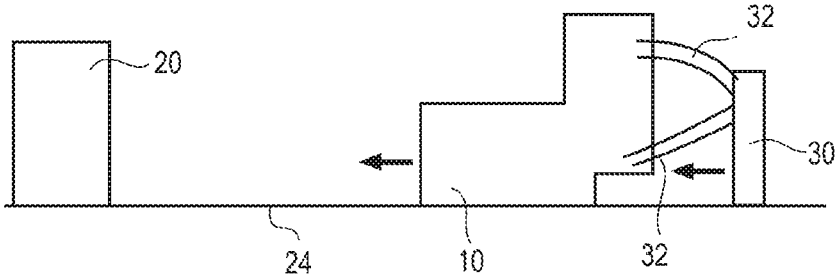
PRIOR ART Fig. 4
FIG. 4 is a schematic side view of a second embodiment of a known method of slicing a food item.
Figure 5:
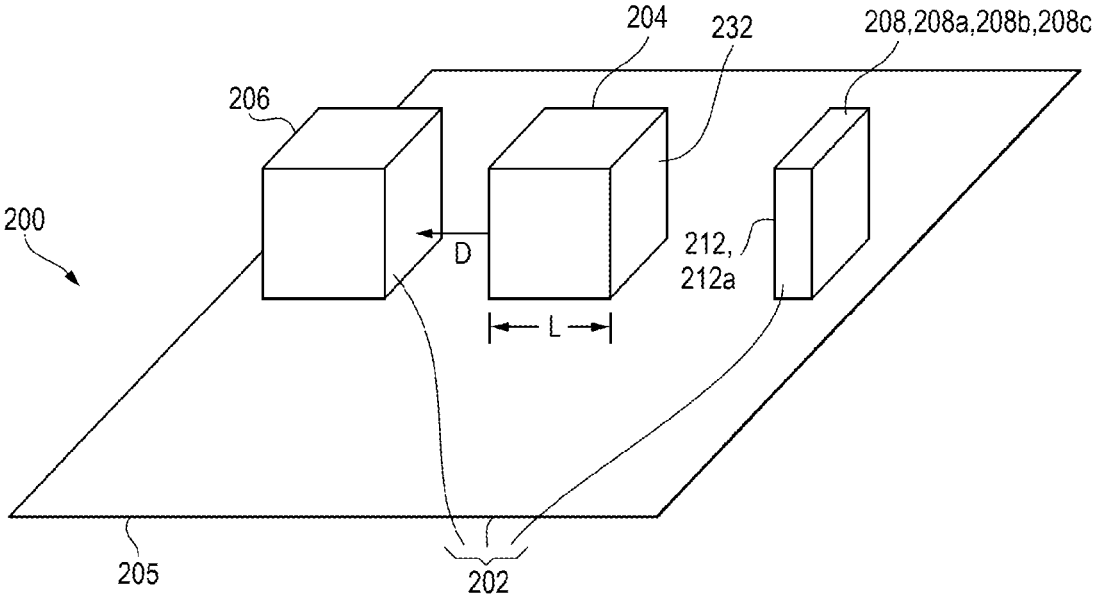
FIG. 5 is a schematic view of an embodiment of a slicing system that can be used to perform one or more methods of slicing a food item in accordance with the present invention.
Figure 6:
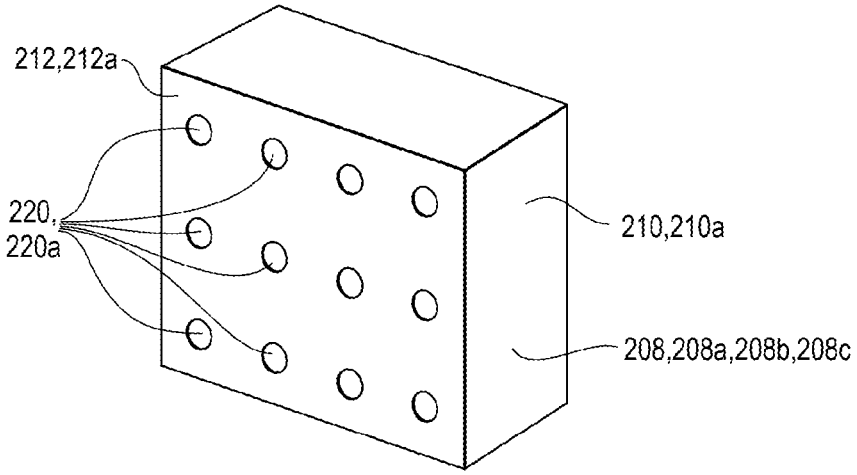
FIG. 6 is a schematic, perspective view of a first embodiment of a pressing device to be used with the slicing system of FIG. 5.
Figure 16A:
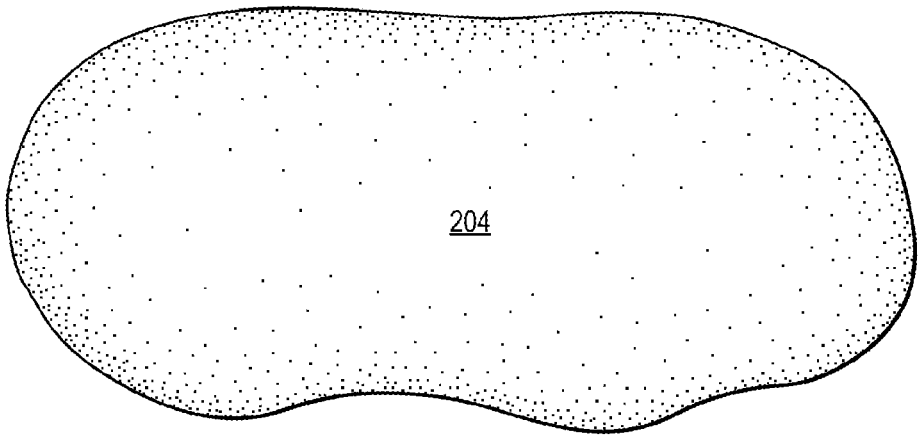
FIG. 16A shows an example of a food item to be sliced by a first variation of a slicing process performed by the slicing system of FIG. 5 in accordance with the present invention.
Figure 16B:
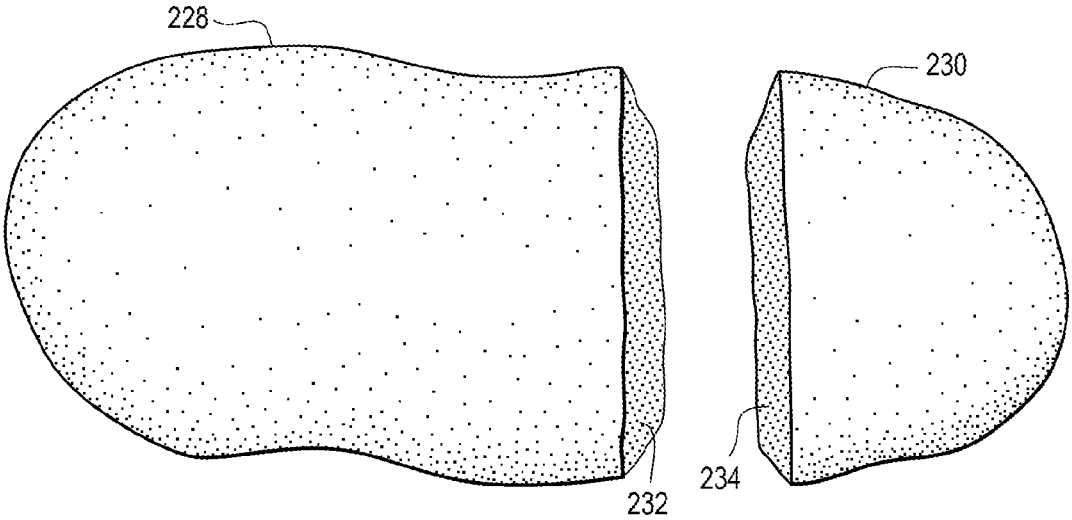
FIG. 16B shows the food item of FIG. 16A cut into two portions in accordance with the first variation of the slicing process associated with the food item of FIG. 16A performed by the slicing system of FIG. 5 in accordance with the present invention.

Note that the shapes of item 204 drawn and shown in FIGS. 5 and 16A-B are for illustrative purposes only and should not be taken as an admission that such shapes were previously known or previously used with slicers.

As shown in FIGS. 5-8, the slicing mechanism 202 includes a planar-like support surface 205 upon which item 204 rests. The support surface 206 can be the top surface of a table, for example. The slicing mechanism 202 includes an automated slicer 206 that is positioned at one end of the support surface 205. The automated slicer 206 can be embodied as a rotating blade or knife, a reciprocating knife, a guillotine knife, or a water jet.

As shown in FIGS. 5-8, the slicing mechanism 202 further includes a pressing device or vacuum support 208, 208*a*, 208*b*, 208*c* that is located at an end of the support surface 205 that is opposite to the end of the support surface 205 to which the automated slicer 206 is positioned. Item 204 is positioned between the automated slicer 206 and the pressing device 208, 208*a*, 208*b*, 208*c*.

As shown in FIGS. 5-8, one embodiment of a pressing device 208 includes a housing 210 that has an exterior surface 212 that is substantially planar. Within the housing 210 is an interior chamber 214 that is in fluid communication with a vacuum source 216 via a conduit 218. When the vacuum source 216 is activated, the interior pressure within the interior chamber 214 is less than the pressure of the ambient atmosphere 222. Examples of a possible vacuum source 216 are a rotary vacuum pump, a piston vacuum pump or a compressed air vacuum generator.

As shown in FIGS. 5-8, the exterior surface 212 of the pressing device 208 includes an array/matrix of openings 220, wherein each opening 220, when open, is in fluid communication with the ambient atmosphere/environment 222 and the interior chamber 214. The size of the array/matrix of openings can vary and can have the form of n×n arrays, wherein n is an integer greater than or equal to 2.

Figure 7:
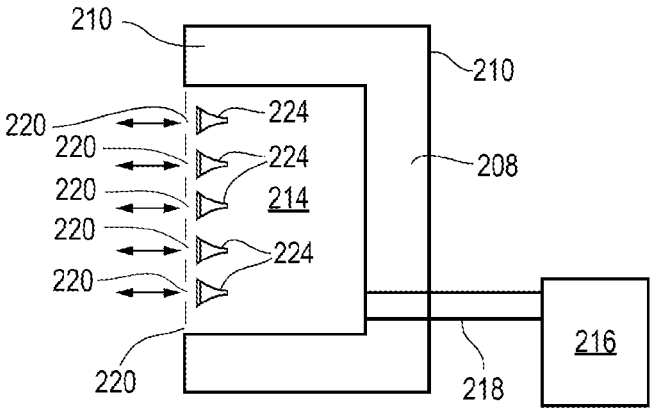
FIG. 7 is a schematic, cross-sectional view of the pressing device of FIG. 6 that has an array of valves.
Figure 8:
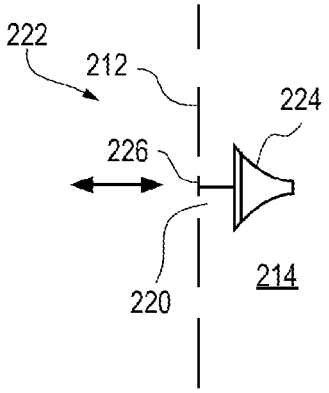
FIG. 8 is an enlarged portion of the schematic, enlarged cross-sectional view of the pressing device of FIG. 7 that shows an enlarged version of one of the array of valves of FIG. 7.

As shown in FIGS. 7-8, each opening 220 houses a valve 224. The valves 224 are centered on their corresponding openings 220 and so are separated from one another by the same center-to-center distances between the openings 220, such as 0.030". Each valve 224 is positioned within its corresponding opening 220 and movable from a first position, wherein the corresponding opening 220 is closed, to a second position, wherein the corresponding opening 220 is open (double arrows in FIG. 7 represent such movement). Each valve 224 has a structure that will result in the valve being biased to the first position when exposed to an interior pressure of 12 psi within the interior chamber 214 and there is an ambient/exterior pressure of 1 atmosphere. In other words, when there is a pressure differential between the interior chamber 214 and the exterior of the housing 210 of 2.5 psi, then the valve 224 is biased to the first position.

As shown in FIG. 8, each valve 224 includes an actuator 226 that is integrally formed therewith and extends away from the housing 210. The maximum distance a free end of the actuator 226 extends past the exterior surface 212 is approximately 0.04 inches. The actuator 226 allows for moving the valve 224 to the second position wherein the valve 224 is open. In particular, when a portion of item 204 makes contact with the actuator 226 and presses the actuator 226 with a sufficient force towards the interior 214, such as 0.1 lbf (pound-force), it will cause the valve 224 to move to the second position. When the valve 224 is at the second position, the corresponding opening 220 is opened so that the vacuum-like pressure within interior chamber 214 is exposed to an area of the item 204 that is adjacent to the corresponding opening 220, which causes the area to be attracted to and pulled against the exterior surface 212.

If item 204 is sufficiently large it will engage multiple valves 224 due to the pressing of item 204 on the actuators 226 with sufficient force/pressure. Thus, multiple areas of item 204 will be attracted to and be captured by the pressing device 208 by having the multiple areas adhere to the exterior surface 212 during the slicing operation as described below.

Figure 9:
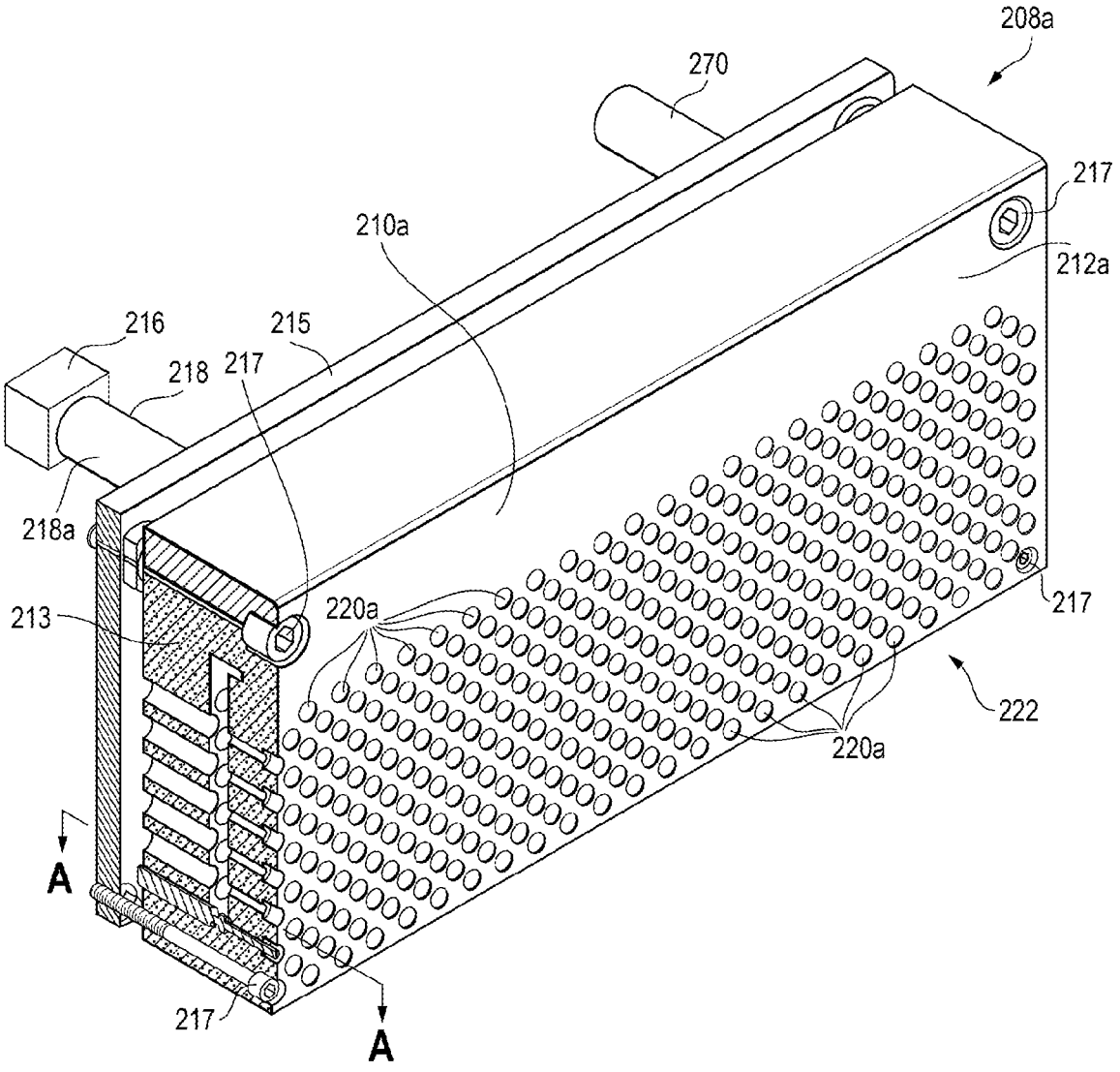
FIG. 9 is a schematic, perspective view of a second embodiment of a pressing device to be used with the slicing system of FIG. 5.
Figure 10:
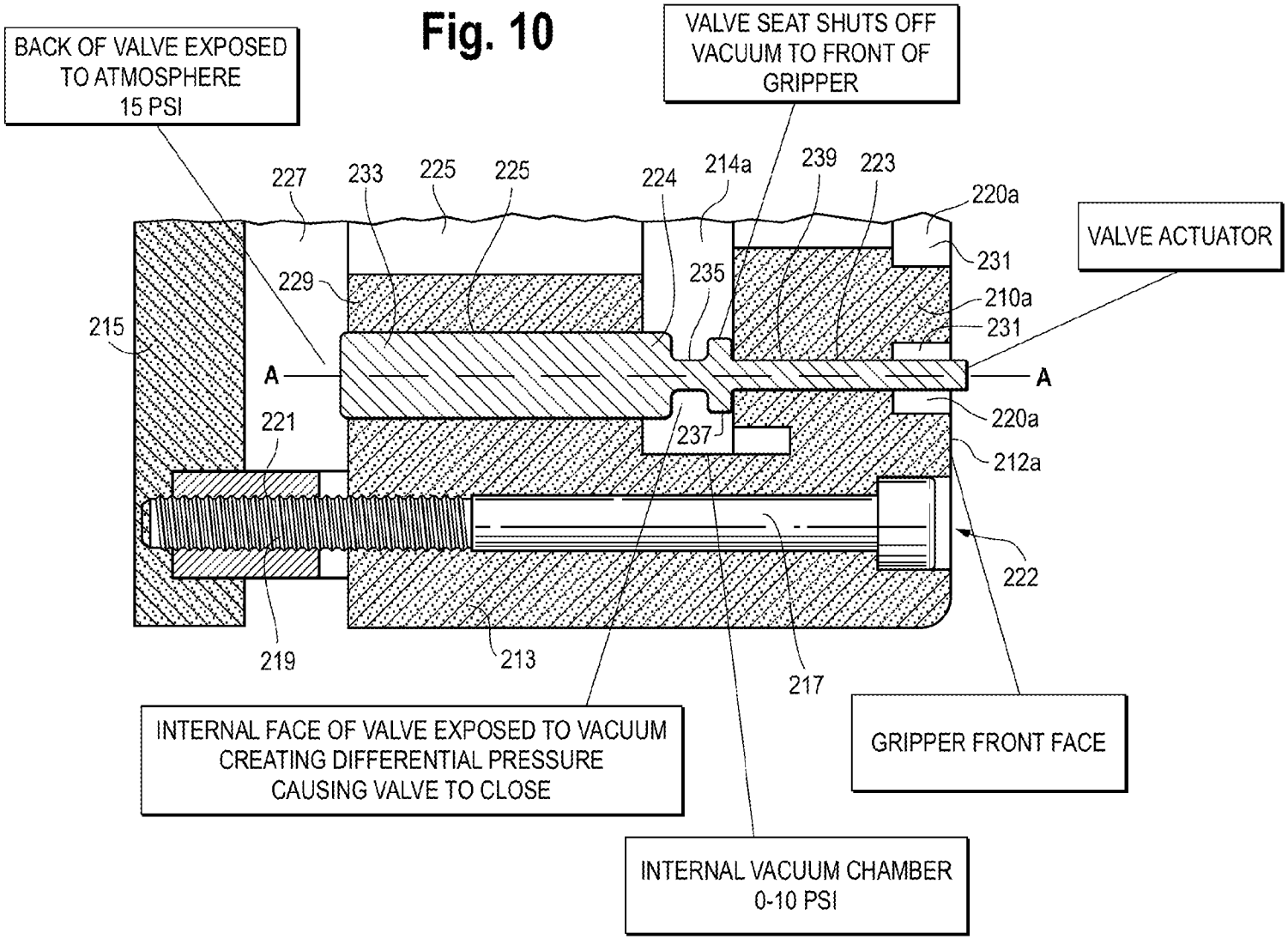
FIG. 10 is a schematic, cross-sectional view of one of the valves of the pressing device of FIG. 9 as taken along line A-A of FIG. 9 when the valve is in a closed position.
Figure 11:
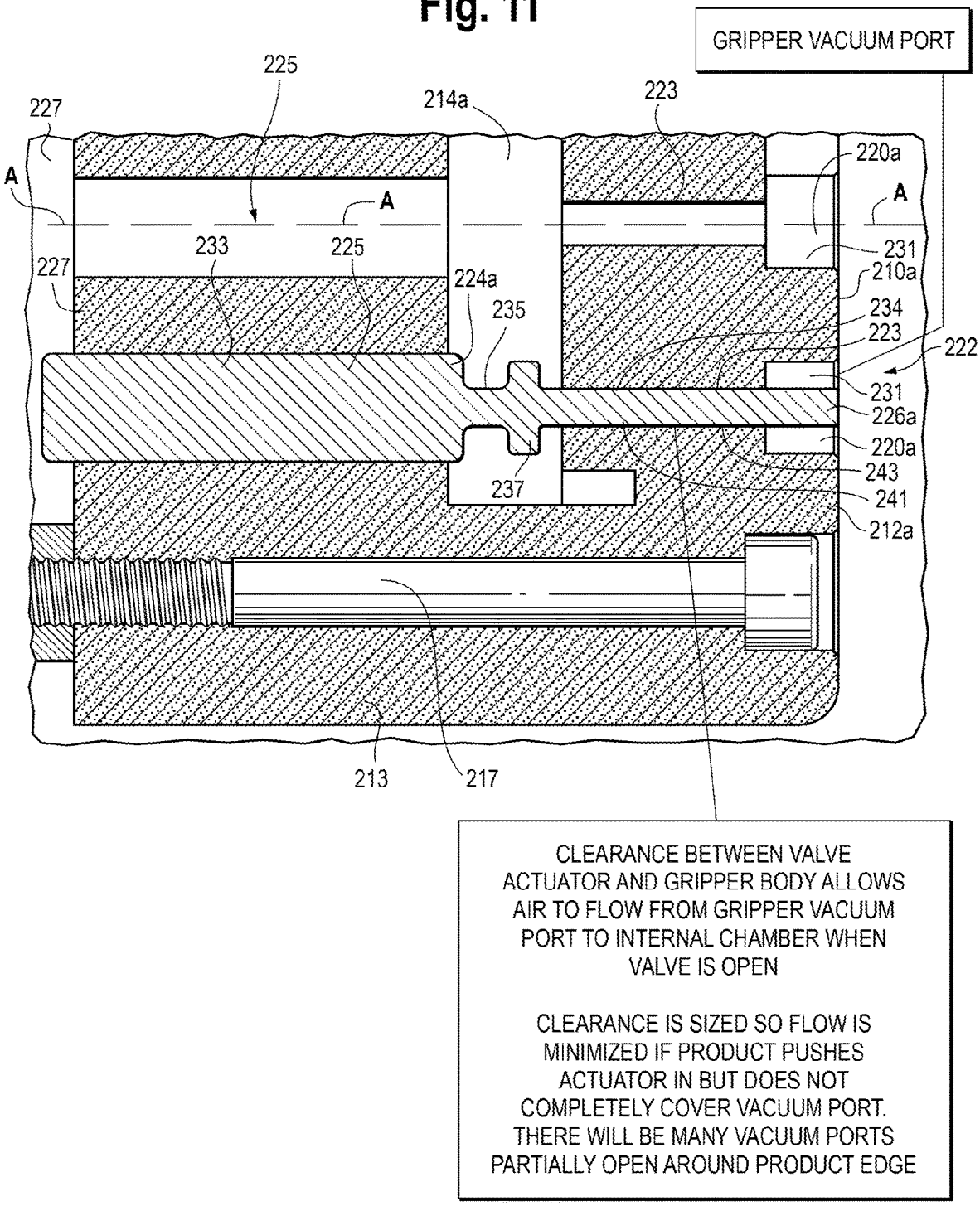
FIG. 11 is a schematic, enlarged cross-sectional view of the valve of FIG. 10 as taken along line A-A of FIG. 9 when the valve is in an open position.

A second embodiment of a pressing device to be used with the slicing system of FIG. 5 is shown with the pressing device 208*a* of FIGS. 9-11. As shown in FIG. 9, the pressing device 208*a* includes a housing 210*a* that has a front exterior surface 212*a* that is substantially planar and is integrally formed with a body 213 of the housing 210*a*. Note that other housings can be used wherein different patterns of openings 220*a* can be used, such as shown by the housing 210*b* of FIGS. 14A-B. At a rear portion of the body 213 of FIG. 9, a rear plate 215 is attached to the body 213 and front exterior surface 212*a* via four bolts 217 that have end threads 219 that engage threaded openings 221 of the rear plate 215 as shown in FIGS. 10-12 and 13B.

Within the housing 210*a* is an interior chamber 214*a* that is in fluid communication with a vacuum source 216 via a conduit 218*a*. The interior chamber 214*a* is in the shape of a rectangular-like box that extends length wise and height wise so that the chamber 214*a* intercepts each of the openings 220*a* of the pressing device 208*a*. As shown in FIGS. 9-11, the exterior surface 212*a* of the pressing device 208*a* includes an array/matrix of openings 220*a*, wherein each opening 220*a* includes 1) a cylindrical port 231, 2) a first cylindrical channel 223 in fluid communication with port 231, and 3) a second cylindrical channel 225 that is in fluid communication with the first cylindrical channel 223 via intervening chamber 214. The port 231, the first cylindrical channel 223, and the second cylindrical channel 225 share a common longitudinal axis A (denoted by dashed lines in FIGS. 10-11). The diameters of port 231, first cylindrical channel 223, and second cylindrical channel 225 are approximately 0.300", 0.125", and 0.300", respectively. The opening 220*a*, when open, is in fluid communication with the ambient atmosphere/environment 222 and the interior chamber 214*a* via the first cylindrical channel 223. As shown in FIGS. 10-11, the second cylindrical channel 225 extends from the interior chamber 214*a* to a rear chamber 227 formed between a rear wall 229 of the body 213 of the housing 210*a*. The rear chamber 227 is open so as to be in fluid communication with the ambient atmosphere 222. In another embodiment, the rear chamber 227 can be closed and have a port, which will be open to the atmosphere or connected to a pressure or vacuum source via a regulator. The size of the array/matrix of openings 220*a* can vary and can have the form of n×n arrays, wherein n is an integer greater than or equal to 2.

Figure 9A:
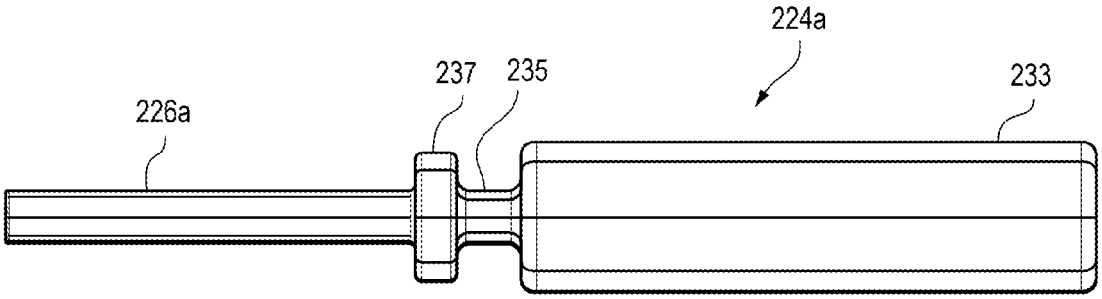
FIG. 9A is a schematic, side view of an embodiment of a valve to be used with the pressing device of FIG. 9.

As shown in FIGS. 10-11, each opening 220*a* houses a valve 224*a*. Each valve 224*a* has a rear cylindrical-like body 233 that is positioned within channel 225 and has approximately the same diameter as the channel 225 so that little, if any, gas within chamber 227 escapes into channel 225. As shown in FIGS. 9A, 10 and 11, the body 233 is integrally connected to a neck 235 which in turn is integrally attached to valve seat 237 that is in the form of a cylindrical disc. The front end of the valve seat 237 is integrally attached to a cylindrical actuator 226*a*. The valve 224*a* is substantially symmetric with respect to a longitudinal axis that passes through the center of the valve 224*a*. As shown in FIGS. 10-11, the actuator 226*a* is offset within the channel 223 such that a side 239 of the actuator 226*a* abuts the wall of the channel 223. On the opposite side 241 of the actuator 226*a*, there is formed a gap/clearance 243 that extends from the valve seat 237 towards the port 231. The clearance 243 provides a separation between the side 241 of the actuator 226*a* and the wall of the chamber 223 of about 0.050". Such clearance 243 allows air to flow from the port 231 to the interior chamber 214*a* when the valve 224*a* is at an open position shown in FIG. 11. The size of the separation between the side 241 and the wall of the chamber 223 is chosen so flow is minimized if a portion of a product 204 to be sliced that pushes an actuator 226*a* but does not completely cover port 231. It is envisioned that there may be many ports 231 that are similarly partially open around the edge of the product 204.

As mentioned previously, the port 231 and the channels 223 and 225 are symmetric regarding axis A while the actuator 226*a* and the valve seat 237 are offset with respect to axis A. In an alternative embodiment, the actuator 226*a* and the valve seat 237 are symmetric regarding axis A and the channel 223 is offset with respect to axis A so that clearance 243 is formed as previously described. In yet another embodiment, the channel 223 can be centered about actuator 226*a*, wherein a clearance 243 between the sides 239, 241 of the actuator 226*a* and the wall of the chamber 223 is about 0.025".

In operation, when the actuator 226*a* of a valve 224*a* is not pressed by an item 204 to be sliced, the valve 224*a* is in a closed position. This is so because the force generated by the atmospheric pressure present in chamber 227 (supplied via conduit 270). and exerted on the body 233 is larger than the force generated by the atmospheric pressure on the actuator 226*a* and so the pressure differential between the chamber 227 and the internal chamber 214*a* (pressure less than 10 psi) causes the valve seat 237 to move to the right shown in FIG. 10 and seal off the internal chamber 214*a* from the first channel 223. Thus, no vacuum is generated from opening 220*a*.

As shown in FIG. 11, when a portion of the item 204 contacts the protruding end of the actuator 226*a* with sufficient force, such as 1 lb, to overcome the force that results in the valve seat 237 sealing off channel 223 as shown in FIG. 10, then the valve seat 237 moves away from channel 223 and allows the low pressure of inner chamber 214*a* to be exposed to the port 231 so that the item 204 is exposed to the low pressure present in chamber 214*a* and further pressed against the front exterior surface 212*a*. Note that in the closed position of the valve 224*a*, the maximum distance a free end of the actuator 226*s* extends past the exterior surface 212 is approximately 0.04 inches. If item 204 is sufficiently large it will engage multiple valves 224*a* due to the pressing of item 204 on the actuators 226*a* with sufficient force/pressure. Thus, multiple areas of item 204 will be attracted to and be captured by the pressing device 208*a* by having the multiple areas adhere to the exterior surface 212 during the slicing operation as described below.

Figure 12:
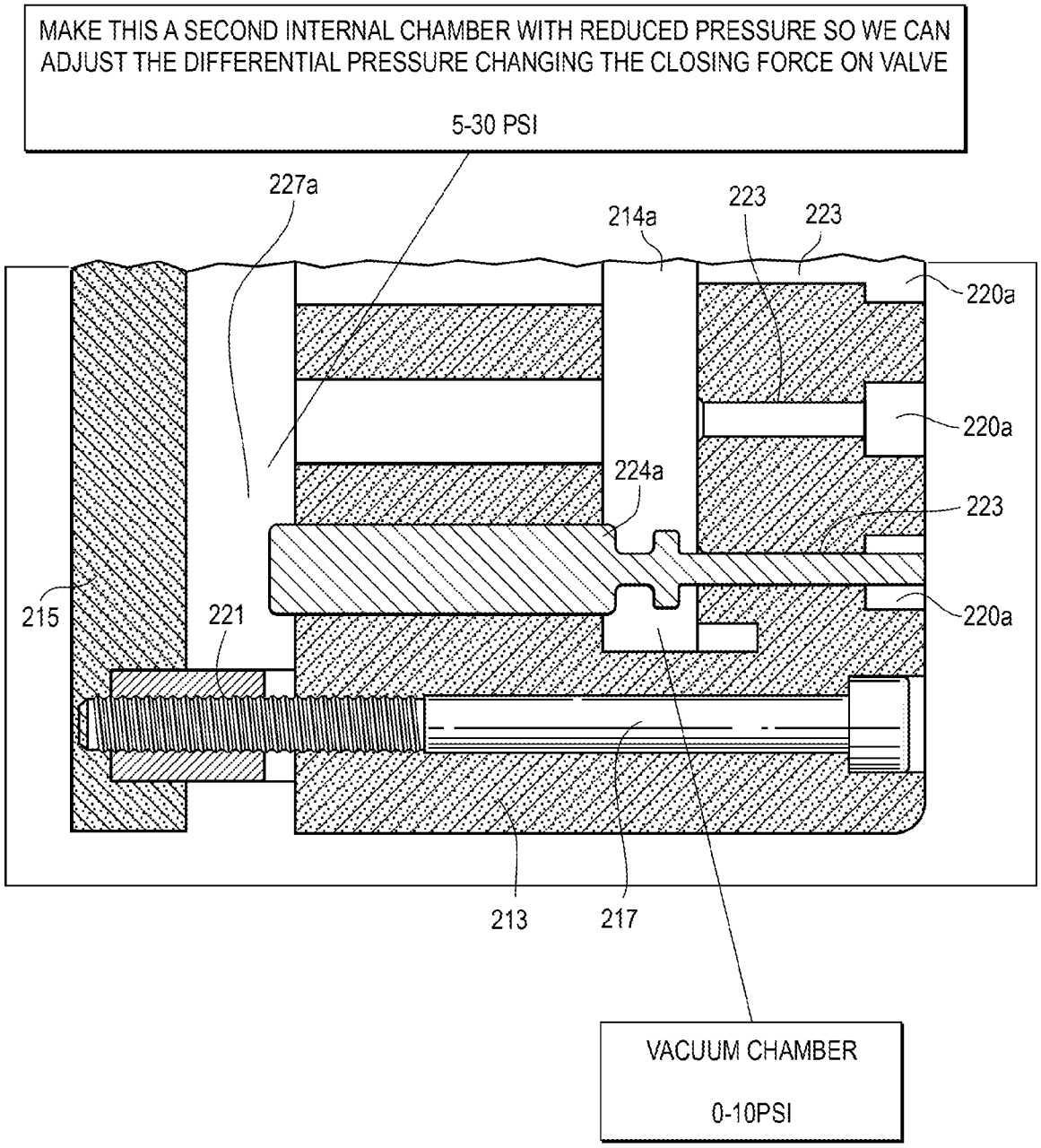
FIG. 12 is a cross-sectional view of a third embodiment of a pressing device to be used with the slicing system of FIG. 5, wherein a valve is in an open position.
Figure 13A:
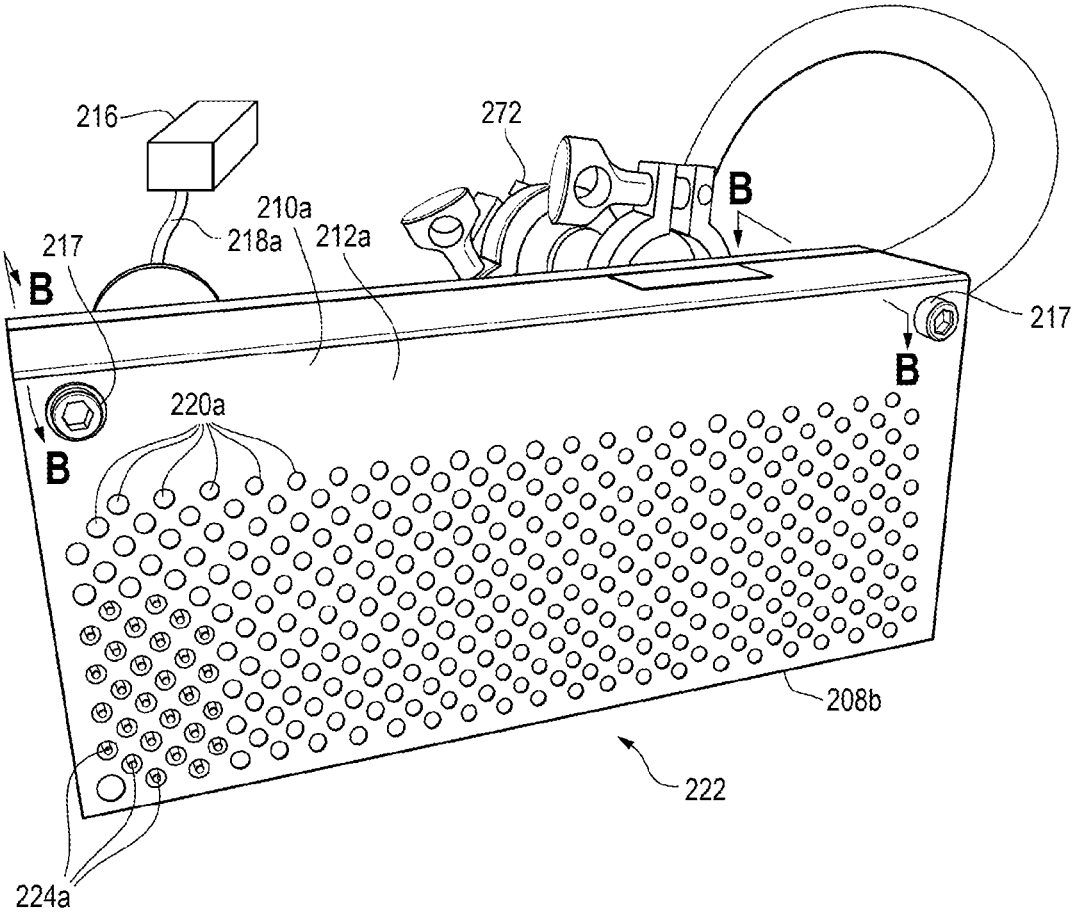
FIG. 13A is a perspective view of the pressing device of FIG. 12, wherein an embodiment of a vacuum system and source of pressurized air to be used with the pressing device are shown.
Figure 13B:
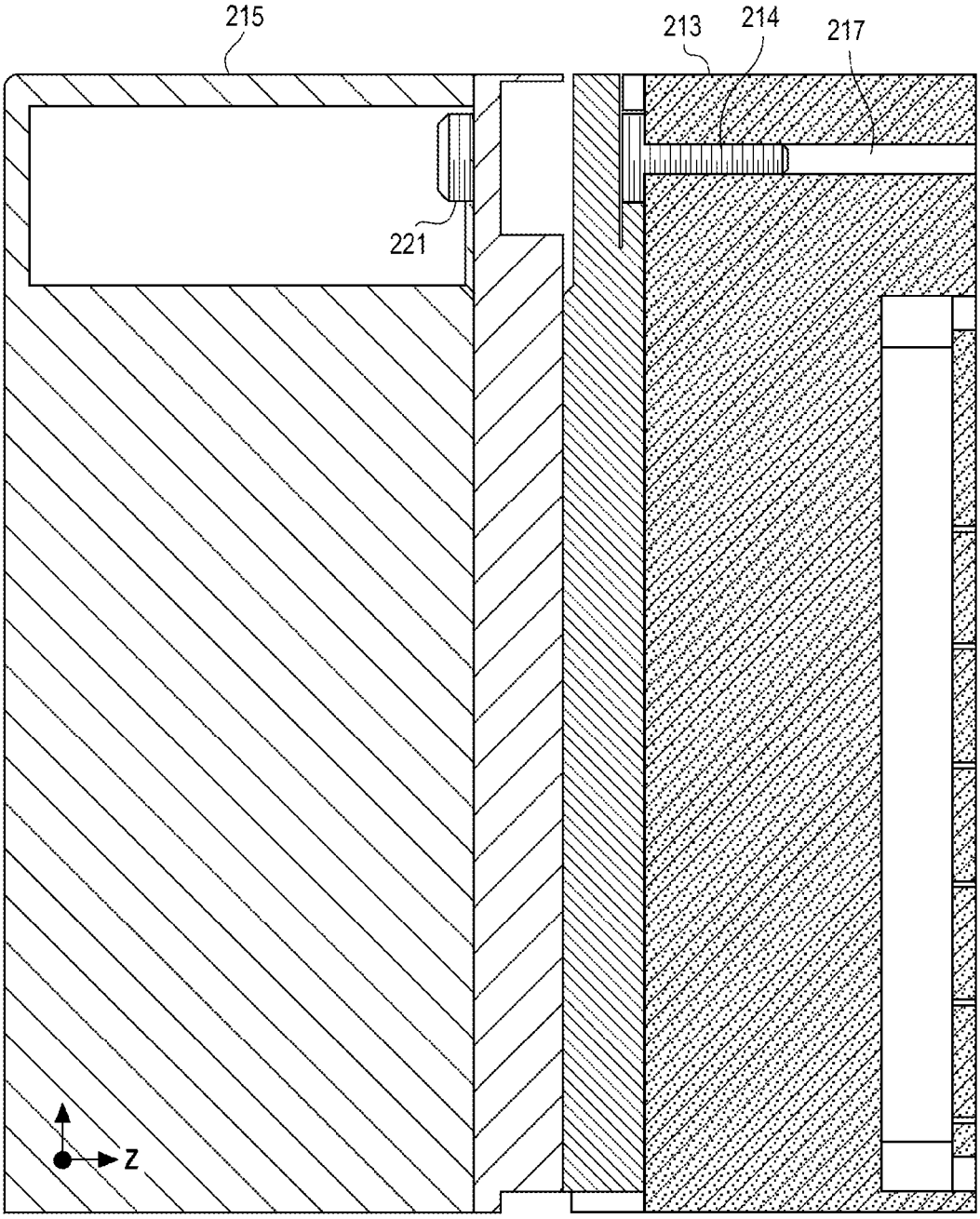
FIG. 13B is a cross-sectional view of a portion of the pressing device of FIGS. 12 and 13A taken along line B-B of FIG. 13A.
Figure 14A:
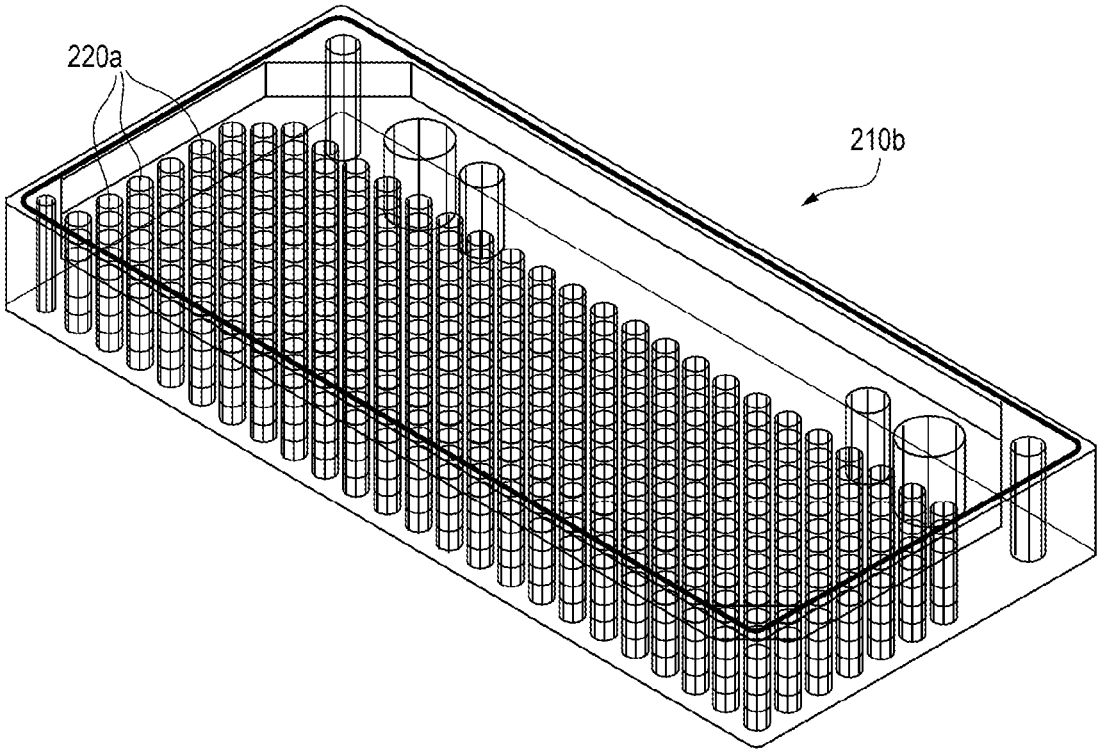
FIG. 14A schematically shows a perspective view of a second embodiment of a housing that can be used to replace the housings of the pressing devices of FIGS. 9-13A-B.
Figure 14B:
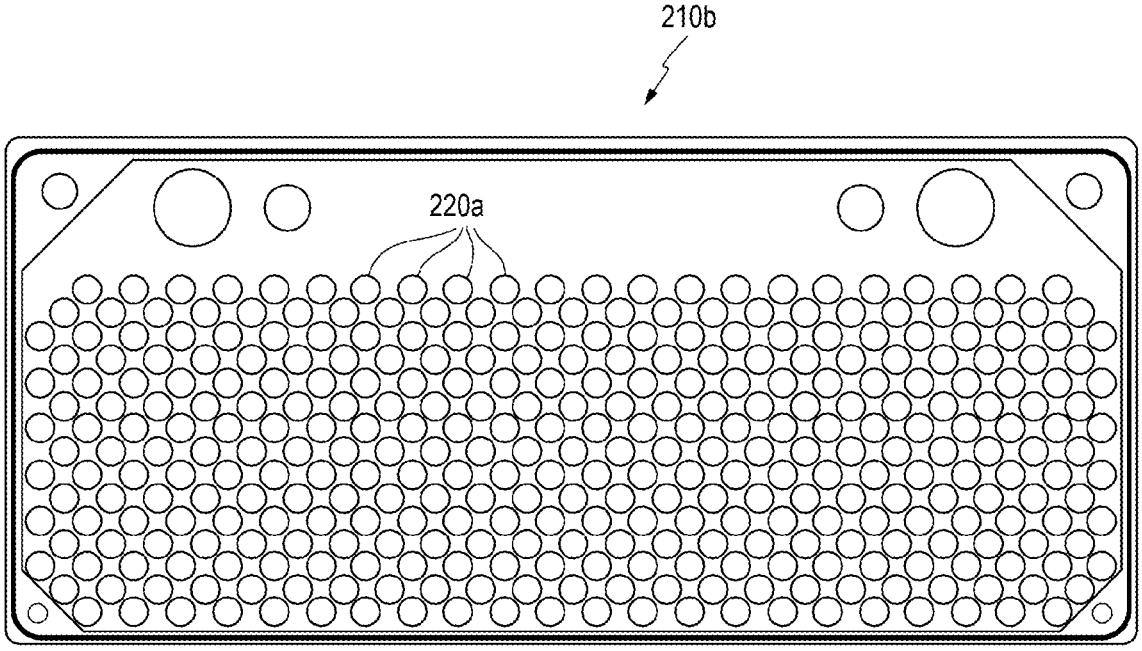
FIG. 14B schematically shows a front view of the housing of FIG. 14A.

A variation of the pressing device 208*a* of FIGS. 9-11 is shown in the pressing device 208*b* of FIGS. 12 and 13A-B, wherein the only significant difference between the pressing devices is that rear chamber 227*a* is a closed chamber that contains a gas at a predetermined pressure ranging from 5 to 30 psi. The rear chamber 227*a* can have a port (not shown) that is open to the atmosphere or connected to a pressure or vacuum source via a regulator (not shown). In addition, gas can be supplied to chamber 227*a* by a gas source 272 as shown in FIG. 13A, wherein a pressure regulator and manual valve may be included. By having the pressure within rear chamber 227*a* at a different pressure than that of rear chamber 227 of FIGS. 9-11, it allows the differential in forces exerted on the body 233 and actuator 226*a* to be adjusted so that the force needed to open the valve can be adjusted in value from 5 to 30 psi. Assuming the atmospheric pressure in the ambient atmosphere 222 to which the actuator 226*a* is exposed is 15 psi (1 lb) then modifying the pressures within rear chamber 227*a* to be in the range of 5-30 psi will result in the force required to move the actuator 226*a* to the open position (see FIG. 11 as an example of the open position) to be in the rage of 0.3 to 2.0 lbs.

Figure 15A:
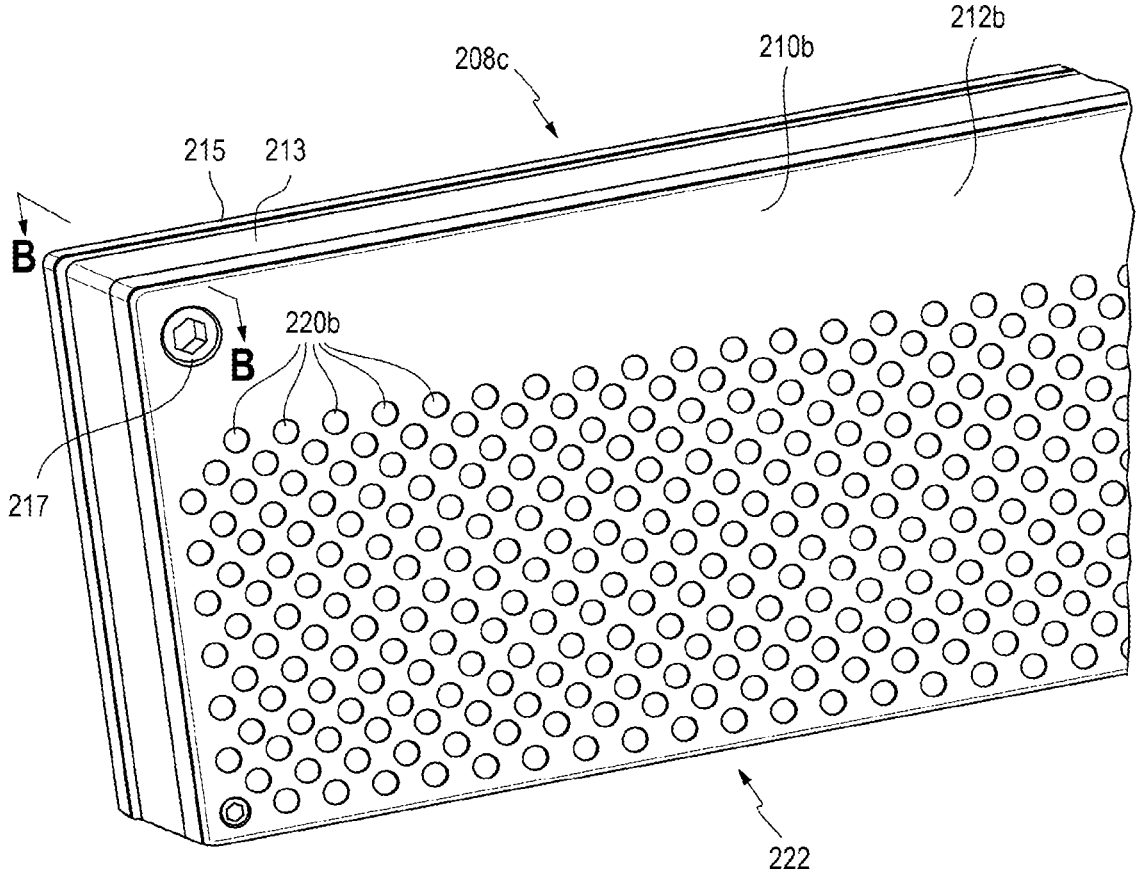
FIG. 15A is a perspective view of a fourth embodiment of a pressing device to be used with the slicing system of FIG. 5.
Figure 15B:
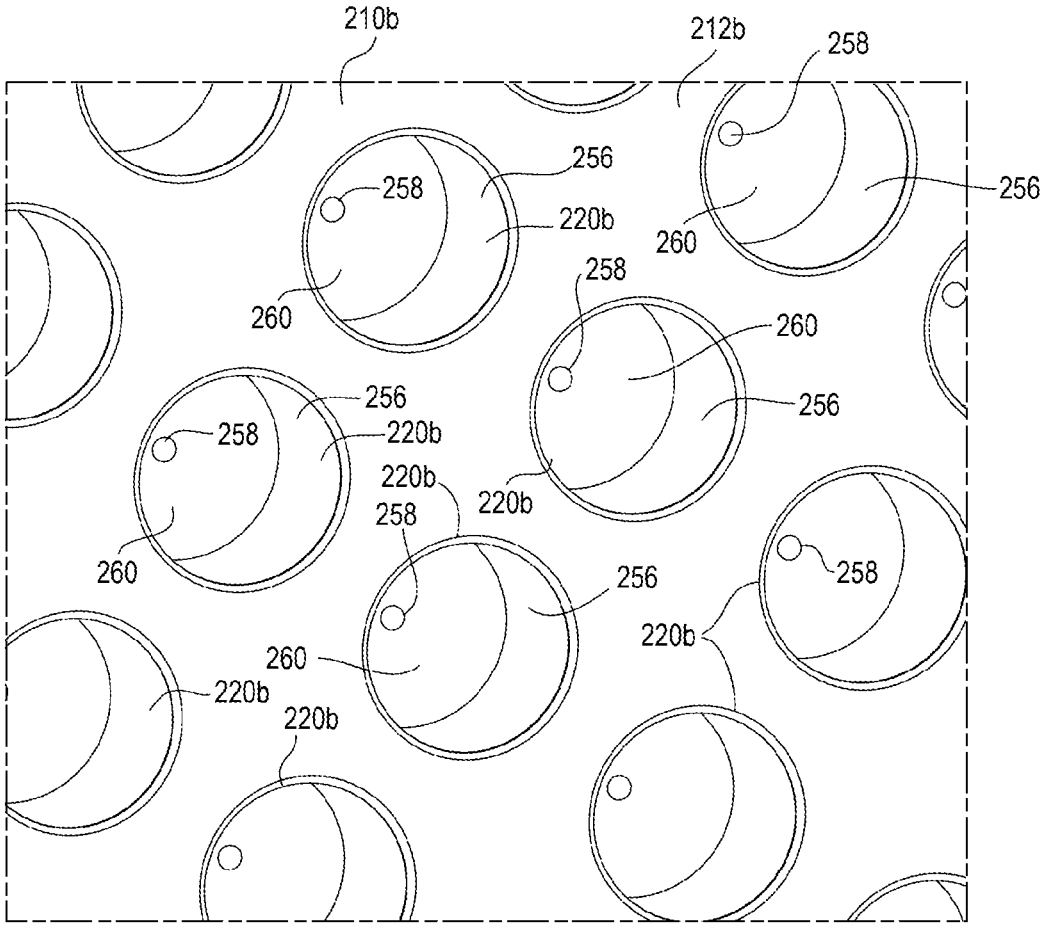
FIG. 15B is an enlarged view of a portion of the pressing device of FIG. 15A.

As shown in FIGS. 15A-B, one embodiment of a pressing device 208*c* includes a housing 210*b* that has an exterior surface 212*b* that is substantially planar. Within the housing 210*b* is an interior chamber (not shown) that is in fluid communication with a vacuum source (not shown). When the vacuum source is activated, the interior pressure within the interior chamber is less than the pressure of the ambient atmosphere 222.

As shown in FIGS. 15A-B, the exterior surface 212*b* of the pressing device 208*c* includes an array/matrix of openings 220*b*, wherein each opening 220*b* is in fluid communication with the ambient atmosphere/environment 222 and the interior chamber. The size of the array/matrix of openings can vary and can have the form of n×n arrays, wherein n is an integer greater than or equal to 2.

As shown in FIG. 15B, each opening 220*b* has a vacuum port composed of cylindrical wall 256 with a central hole 258 positioned on a base 260 of the opening 220*b*. The central hole 258 is in fluid communication with the interior chamber mentioned previously. The wall 256 defines a cylinder having a diameter of approximately 0.300". The hole 258 has a diameter of approximately 0.030", wherein the size of hole 258 is small enough to restrict air flow into the vacuum chamber to such an extent that a sufficient negative pressure is established within the interior chamber. Note that the total leakage of air into all holes from the ambient atmosphere 222 is less than the pump rate for the vacuum source when 25% of the openings 220*b* are blocked by the item 204. What this means is that if all opening 220*b* are open, the internal vacuum level will be less than a full predetermined vacuum level, such as 0 to 5 psi, because the flow of air through all the openings 220*b* into the interior chamber will lessen the internal vacuum level within the interior chamber. If item 204 blocks at least 25% or more of the openings 220*b*, the flow rate of air into the interior chamber from the remaining percentage of the uncovered openings 220*b* is not sufficient to prevent the vacuum pump from generating a full predetermined vacuum level within the interior chamber. The total leakage for all openings 220*b* described above allows for the use of a reduced sized vacuum pump size, such as that of a 5 hp 70 ACFM vacuum source, and reduced cost for running a vacuum pump. Of course, a larger vacuum pump can be used and the internal pressure level within the interior chamber will be the full predetermined vacuum level even if all openings 220*b* are open.

With the previous description of the slicing system 200 in mind, general operation of the system 200 can be understood. In particular, item 204 is initially positioned between the automated slicer 206 and the exterior surface 212, 212*a*, 212*b* of the pressing device 208, 208*a*, 208*b*, 208*c* as shown in FIG. 5. Next, the exterior surface 212, 212*a* is moved toward item 204 so that in the case of the pressing device 208, 208*a*, 208*b* actuators 226, 226*a* of valves 224, 224*a* that face item 204 are contacted by areas of item 204, wherein such contact is of a sufficient pressure/force to cause the valves 224, 224*a* to move to an open position and results in the areas of the item 204 being subjected to a negative pressure. In each of the pressing devices 208, 208*a*, 208*b*, such negative pressure causes the areas of the item 204 to be captured by the pressing device 208, 208*a*, 208*b* by having the areas adhere to and be pulled against the exterior surface 212. In another variation, the item 204 is moved toward the exterior surface 212.

In the case of the pressing device 208*c* being used, when the exterior surface 212*b* is moved toward item 204 it eventually is contacted by areas of item 204 so that portions of such areas are exposed to one or more of the openings 220*b*. Consequently, the portions are exposed to a negative pressure generated via openings 220*b* of pressing device 208*c* that is of sufficient magnitude that the portions of the item 204 are captured by the pressing device 208*c* to such an extent that the portions adhere to and are pulled against the exterior surface 212*b*. In another variation, the item 204 is moved toward the exterior surface 212*b*.

Once the areas of item 204 are adhered to the exterior surface 212, 212*a*, 212*b*, the exterior surface 212, 212*a*, 212*b* is moved towards the automated slicer 206. This causes item 204 to be moved toward the automated slicer 206 and eventually results in slices of item 204 being generated as the exterior surface 212, 212*a*, 212*b* is continuously moved toward the automated slicer 206. Of course, in another variation, the exterior surface 212, 212*a*, 212*b* and item 204 remain stationary while the automated slicer 206 is translated toward item 204 until sufficient slicing of item 204 occurs.

With the above general process in mind, particular variations will be discussed hereafter. In particular, FIG. 16A shows item 204 prior to being sliced by the slicing system 200 or in any other manner. Next, the item 204 is cut only once by a knife or the like so that two irregular-shaped portions 228 and 230 are formed and are separate from one another as shown in FIG. 16B.

As shown in FIG. 16B, portion 228 has a flat surface or face 232 due to the cutting by the knife or the like mentioned above. Similarly, portion 230 has a flat face 234 that is approximately a mirror image of flat face 232. Once the portions 228 and 230 are formed by cutting by the knife or the like, portion 228 is positioned between the automated slicer 206 and the exterior surface 212, 212*a*, 212*b* of the pressing device 208, 208*a*, 208*b*, 208*c* so that the flat face 232 faces and is parallel to the exterior surface 212, 212*a*. Note that the other end of the portion 228 can be cut so as to remove an unwanted piece and so another flat face is formed, wherein the additional flat face faces the automated slicer 206.

Next, the pressing device 208, 208*a*, 208*b*, 208*c* and its exterior surface 212, 212*a*, 212*b* are moved so that the flat face 232 initially engages the exterior surface 212, 212*a*, 212*b*. As mentioned previously with respect to pressing devices 208, 208*a*, 208*b*, the exterior surface 212, 212*a* has an array of valves 224 that are activated by contact with the flat face 232 so that the flat face 232 is adhered to exterior surface 212, 212*a* by a vacuum. Similarly, contact of the flat face 232 with the exterior surface 212*b* of the pressing device 208*c* will result in similar adherence to the exterior surface 212*b* via a vacuum. In each of the pressing devices 208, 208*a*, 208*b*, and 208*c*, the adherence to the exterior surface 212, 212*a* is sufficient to hold the flat face 232 and the rest of the portion 228 to the pressing device 208, 208*a*, 208*b*, 208*c* during the entire slicing process that will be described below. At this point, the pressing device 208, 208*a*, 208*b*, 208*c* continues to move towards the automated slicer 206 at a uniform speed, which results in the portion 228 also approaching toward the automated slicer 206. Moving at a uniform speed ensures that each of the slices that are no longer attached to the portion 228 have a uniform thickness. Note that the movement could also be done in a step wise manner such that each slice generated has a uniform thickness. The movement of the pressing device 208, 208*a*, 208*b*, 208*c* and portion 228 continues until the portion 228 is engaged by the automated slicer 206 and a desired number of slices of the portion 228 are generated by the automated slicer 206.

Of course, in another variation, the exterior surface 212, 212*a*, 212*b* and portion 228 remain stationary while the automated slicer 206 is translated toward portion 228 until sufficient slicing of portion 228 occurs.

At the time the desired number of slices are generated by the automated slicer 206, the automated slicer 206 is turned off and the pressing device 208, 208*a*, 208*b*, 208*c* and remaining portion of portion 228 are moved away from the automated slicer 206. In the case of pressing devices 208, 208*a*, and 208*b*, the remaining portion can have a thickness as measured in a direction perpendicular to the exterior surface 212, 212*a* that can be at least the maximum distance the free end of the actuator extends past the exterior surface 212, 212*a*. Such a maximum distance is at least 0.04" so as to be greater than the distance the end of the actuator 216*a* extends past the surface 212*a* in the closed position and thus avoid having the automated slicer 206 hitting the valve 224*a*. Preferably, the remaining portion has a thickness that is the same thickness as the slices previously generated by the automated slicer 206. Next, the remaining portion is expelled off of the exterior surface 212, 212*a*, 212*b* so that the remaining portion falls into a container (not shown). In the case that the remaining portion has the same thickness as the other slices, the remaining portion will be expelled into a container that already contains the other slices. Such expelling can be accomplished by turning off the vacuum and applying a positive pressure towards the openings 220, 220*a*, 220*b* of the pressing device 208, 208*a*, 208*b*, 208*c* that results in the remaining portion to fall into the container. In the case of pressing devices, 208, 208*a*, and 208*b*, pressurized air could be supplied to a chamber 214, 214*a*, or 227 which would cause all valves 224, 224*a* to move to the closed position, which in turn would result in the ends of the actuator 226, 226*a* to push the remaining portion off of the pressing device 208, 208*a*, 208*b* and into the container. Such pressurized air can be supplied via a conduit, such as conduit 270 of FIG. 9. In the alternative, expelling can be accomplished by subjecting the remaining portion to a blast of condensed air from an air dispenser (not shown) separate from the pressing device 208, 208*a*, 208*b*, 208*c* that has a sufficient force to overcome the vacuum of the pressing device 208, 208*a*, 208*b*, 208*c* so that the remaining portion falls into the container. After the remaining portion is received by the container, the pressing device 208, 208*a*, 208*b*, 208*c* is moved back to its original position and another item with a flat face like portion 228, such as portion 230, is placed in the slicing system mechanism 202 so that the above process is repeated.

The above described process can be used to slice uniformly-shaped and irregularly-shaped items 204 and portion 228. In the case where the slicing is stopped when the thickness of portion 228 remaining on the pressing device is equal to the thickness of the previously generated slices of portion 228, there is a 100% slice yield and so there are no unusable pieces/slices of portion 228 generated by the automated slicer 206.

In another variation of a method of slicing, an item 204 is to be sliced by the slicing mechanism 202 of FIG. 5. As shown in FIG. 5, the item 204 has a length, L, as measured along a direction of movement, D, that the item 204 moves toward the automated slicer 206. The item 204 can be irregular in shape and have a flat face 232 that faces the pressing device 208, 208*a*, 208*b*, 208*c*.

Item 204 is positioned between the automated slicer 206 and the exterior surface 212 of the pressing device 208, 208*a*, 208*b*, 208*c* so that the flat face 232 faces and is parallel to the exterior surface 212, 212*a*, 212*b*. Next, the pressing device 208, 208*a*, 208*b*, 208*c* and its exterior surface 212, 212*a*, 212*b* are moved so that the flat face 232 initially engages the exterior surface 212, 212*a*. In the case of pressing devices 208, 208*a*, and 208*b*, the exterior surface 212, 212*a* has an array of valves 224, 224*a* that are activated by contact with the flat face 232 so that the flat face 232 is adhered to exterior surface 212, 212*a* by a vacuum. The adherence to the exterior surface 212, 212*a* is sufficient to hold the flat face 232 and the rest of item 204 to the pressing device 208, 208*a*, 208*b* during the entire slicing process that will be described below.

In the case of the pressing device 208*c* being used, when the exterior surface 212*b* is moved toward item 204 it eventually is contacted by areas of item 204 so that portions of such areas are exposed to one or more of the openings 220*b*. Consequently, the portions are exposed to a negative pressure generated via openings 220*b* of pressing device 208*c* that is of sufficient magnitude that the portions of the item 204 are captured by the pressing device 208*c* to such an extent that the portions adhere to and are pulled against the exterior surface 212*b*. The adherence to the exterior surface 212*b* is sufficient to hold the flat face 232 and the rest of item 204 to the pressing device 208*c* during the entire slicing process that will be described below.

A thickness, T, for each of the slices generated by the automated slicer 206 is determined. At this point, the pressing device 208, 208*a*, 208*b*, 208*c* continues to move towards the automated slicer 206 at a uniform speed, which results in item 204 also approaching toward the automated slicer 206. Moving at a uniform speed ensures that each of the slices that are no longer attached to item 204 have the determined thickness, T. Note that the movement could also be done in a step wise manner such that each slice generated has a uniform thickness. The movement of the pressing device 208, 208*a*, 208*b*, 208*c* and item 204 continues until item 204 is engaged by the automated slicer 206 and a maximum possible number, $N_{max}$, of slices of item 204 are generated that have said thickness, T. In this scenario, $N_{max}=L/T$.

Of course, in another variation, the exterior surface 212, 212*a*, 212*b* and item 204 remain stationary while the automated slicer 206 is translated toward item 204 until sufficient slicing of the item 204 occurs.

At the time the maximum number $N_{max}$ slices are generated by the automated slicer 206, the automated slicer 206 is turned off and the pressing device 208, 208*a*, 208*b*, 208*e* and remaining portion of item 204 are moved away from the automated slicer 206. The remaining portion can be considered to be a slice if item 204 and may be irregular in shape. In the case of pressing devices 208, 208*a*, 208*b*, the slice can have a thickness as measured in a direction perpendicular to the exterior surface 212, 212*a* that can be greater than the maximum distance the free end of the actuator extends past the exterior surface 212, 212*a* so as to avoid having the automated slicer 206 hitting the valve 224, 224*a*. Preferably, the remaining portion has a thickness that is the same thickness as the slices previously generated by the automated slicer 206. Next, the remaining portion is expelled off of the exterior surface 212, 212*a*, 212*b* so that the remaining portion falls into a container (not shown). In the case that the remaining portion has the same thickness as the other slices, the remaining portion will be expelled into a container that already contains the other slices. Such expelling can be accomplished by turning off the vacuum and applying a positive pressure through the openings 220, 220*a*, 220*b* of the pressing device 208, 208*a*, 208*b*, 208*c* that results in the remaining portion to fall into the container. In the alternative, expelling can be accomplished by subjecting the remaining portion to a blast of condensed air that has a sufficient force to overcome the vacuum of the pressing device 208, 208*a*, 208*b*, 208*c* so that the remaining portion falls into the container. After the remaining portion is received by the container, the pressing device 208, 208*a*, 208*b*, 208*c* is moved back to its original position and another item with a flat face, like item 204, is placed in the slicing system mechanism 202 so that the above process is repeated.

For the variation described above, item 204 had only one flat face 232 prior to be positioning within slicing mechanism 202. It is possible to cut portion 204 to form an additional flat face that faces the automated slicer 206.

In the variation mentioned above, the thickness, T, was determined prior to the slicing process beginning. Such determination can be made by measuring the length L and determining a thickness T for each slice so that all slices of the item 204 have the thickness, T. As a variation, the thickness T is determined first, and then item 204 is cut so that it has a length L so that all slices of the item 204 have the thickness, T.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

We claim:

1. A method of slicing a food item, the method comprising:

slicing through said food item only once so that a first portion of said food item and a second portion of said item are formed and are separate from one another, wherein said first portion comprises a first flat face where said food item was sliced due to said slicing and said second portion comprises a second flat face where said food item was sliced due to said slicing;

positioning said first portion between an automated slicer and a surface of a pressing device so that only said first flat face faces said surface; and wherein the surface of the pressing device includes a first opening and a second opening; a first valve positioned within said first opening and movable from a first position wherein said first opening is closed to a second position wherein said first opening is open; a second valve positioned within said second opening and movable from a third position wherein said second opening is closed to a fourth position wherein said second opening is open; a vacuum source in fluid communication with an interior chamber, further comprising a second chamber, wherein a pressure within the second chamber is higher than a pressure within the interior chamber due to the vacuum source; wherein said first valve has a structure such that when exposed to said interior pressure said first valve is biased to said first position and the second valve has a structure such that when exposed to said interior pressure said second valve is biased to said third position with the biasing force generated upon the respective first and second valves due to a differential pressure between an air pressure that exists within the second chamber and the lower air pressure within the internal chamber, wherein each of the first and second valves includes a free end portion that extends through the respective first and second openings and past the surface approximately 0.04 inches when the first and second valves are in the respective first and third positions and wherein when the first and second valves are moved toward their respective second and fourth positions the respective free end portions are withdrawn into the first and second openings, the flat surface of the first portion of the food item contacting the surface of the pressing device and the first and second valves, and applying a force to the first and second valves sufficient to cause the first and second valves to move toward the respective second and fourth positions, which allows communication between the first flat face of the first portion with the vacuum source such that the first flat face adheres to the surface;

moving said surface so as to approach said automated slicer, wherein during said moving said first flat face engages said surface and said first portion is sliced by said automated slicer.

2. The method of claim 1 further comprising:

wherein prior to said food item being sliced by said automated slicer said food item that is being moved has a length, L, as measured along said direction;

determining a thickness, T, of a slice of said food item to be generated by said automated slicer; and slicing said food item that has said length, L, by said automated slicer so that a maximum possible number, $N_{max}$, of slices of said food item are generated that have said thickness, T.

3. The method of claim 2, wherein said flat surface of the first food portion that is sliced last by said automated slicer has an irregular shape.

4. The method of claim 2, wherein when said automated slicer performs its last slice of said food item a final slice of said food item is captured by said pressing device and subsequently said final slice is expelled from said pressing device, wherein said final slice is captured by said pressing device via a vacuum being applied to said final slice and said final slice is expelled from contact with said pressing device by subjecting said final slice to compressed air.

5. The method of claim 1, wherein during the positioning of said first portion between said automated slicer and said surface of said pressing device, a non-flat portion of said food item faces said automated slicer.

6. The method of slicing a food item of claim 1, wherein each of the interior chamber and the second chamber are fluidly connected with the first and second openings, wherein respective first and second valves each extend from the respective first and second openings, through the interior chamber, and toward the second chamber, wherein each of the first and second valves have a valve seat disposed within the interior chamber, wherein when the interior chamber is exposed to the vacuum source and the respective free end portion extends past the surface, the respective valve seat blocks fluid communication between the interior chamber and the respective opening due to the differential pressure between the second and interior chambers acting upon the valve between the valve seat and a rear portion of the valve that faces the second chamber.

7. The method of claim 6, wherein when the respective free end portion is pressed toward the surface, the respective valve is translated along its longitudinal axis to allow fluid communication between the interior chamber and the respective opening through a channel that connects the interior chamber and the respective opening.

8. The method of claim 6, wherein first and second openings each have a diameter that is greater than a diameter of the respective channel leading to the first and second openings.

9. The method of claim 8, wherein the channel is symmetric with respect to a longitudinal axis through the channel and the valve through the channel is offset with respect to the longitudinal axis, such that one side portion of the valve abuts a wall portion of the channel and an opposite second side portion forms a gap between the second side portion and the valve to allow air flow along the channel between the first chamber and the opening when the valve seat does not block fluid communication.

10. The method of claim 9, wherein the gap is about 0.050 inches.

11. The method of claim 8, wherein the valve extending within the channel is symmetric with respect to a longitudinal axis through the channel and the channel is offset with respect to the longitudinal axis, such that one side portion of the valve abuts a wall portion of the channel and an opposite second side portion forms a gap between the second side portion and the valve to allow air flow along the channel between the first chamber and the opening when the valve seat does not block fluid communication.

12. The method of claim 8, wherein the channel is symmetric with respect to a longitudinal axis therethrough, and valve extending through the channel is symmetric with respect to the longitudinal axis, wherein the valve extending through the channel is sized to establish the gap of about 0.025 inches around the circumference of the valve extending through the channel.

13. The method of claim 6, wherein the second chamber is at atmospheric pressure.

14. A method of slicing a food item, the method comprising:

slicing through said food item only once so that a first portion of said food item and a second portion of said item are formed and are separate from one another, wherein said first portion comprises a first flat face where said food item was sliced due to said slicing and said second portion comprises a second flat face where said food item was sliced due to said slicing;

positioning said first portion between an automated slicer and a surface of a pressing device so that only said first flat face faces said surface; and wherein the surface of the pressing device includes a first opening and a second opening; a first valve positioned within said first opening and movable from a first position wherein said first opening is closed to a second position wherein said first opening is open; a second valve positioned within said second opening and movable from a third position wherein said second opening is closed to a fourth position wherein said second opening is open; a vacuum source in fluid communication with an interior chamber, further comprising a second chamber, wherein a pressure within the second chamber is higher than a pressure within the interior chamber due to the vacuum source, wherein said first valve has a structure such that when exposed to said interior pressure said first valve is biased to said first position and the second valve has a structure such that when exposed to said interior pressure said second valve is biased to said third position with the biasing force generated upon the respective first and second valves due to a differential pressure between an air pressure that exists within the second chamber and the lower air pressure within the internal chamber, the flat surface of the first portion of the food item contacting the surface of the pressing device and the first and second valves, and applying a force to the first and second valves sufficient to cause the first and second valves to move toward the respective second and fourth positions, which allows communication between the first flat face of the first portion with the vacuum source such that the first flat face adheres to the surface;

moving said surface so as to approach said automated slicer, wherein during said moving said first flat face engages said surface and said first portion is sliced by said automated slicer.

15. The method of claim 14 further comprising:

wherein prior to said food item being sliced by said automated slicer said food item that is being moved has a length, L, as measured along said direction;

determining a thickness, T, of a slice of said food item to be generated by said automated slicer; and slicing said food item that has said length, L, by said automated slicer so that a maximum possible number, $N_{max}$, of slices of said food item are generated that have said thickness, T, wherein $N_{max}=L/T$.

16. The method of claim 15, wherein when said automated slicer performs its last slice of said food item a final slice of said food item is captured by said pressing device and subsequently said final slice is expelled from said pressing device, wherein said final slice is captured by said pressing device via a vacuum being applied to said final slice and said final slice is expelled from contact with said pressing device by subjecting said final slice to compressed air.

17. The method of claim 14, wherein each of the interior chamber and the second chamber are fluidly connected with the first and second openings, wherein respective first and second valves each extend from the respective first and second openings, through the interior chamber, and toward the second chamber, wherein each of the first and second valves have a valve seat disposed within the interior chamber, wherein when the interior chamber is exposed to the vacuum source and the respective free end portion extends past the surface, the respective valve seat blocks fluid communication between the interior chamber and the respective opening due to the differential pressure between the second and interior chambers acting upon the valve between the valve seat and a rear portion of the valve that faces the second chamber.

18. The method of claim 17, wherein the second chamber is at atmospheric pressure.

19. The method of claim 17, wherein when the respective free end portion is pressed toward the surface, the respective valve is translated along its longitudinal axis to allow fluid communication between the interior chamber and the respective opening through a channel that connects the interior chamber and the respective opening.

20. The method of claim 17, wherein first and second openings each have a diameter that is greater than a diameter of the respective channel leading to the first and second openings.

21. The method of claim 20, wherein the valve extending within the channel is symmetric with respect to a longitudinal axis through the channel and the channel is offset with respect to the longitudinal axis, such that one side portion of the valve abuts a wall portion of the channel and an opposite second side portion forms a gap between the second side portion and the valve to allow air flow along the channel between the first chamber and the opening when the valve seat does not block fluid communication.

22. The method of claim 20, wherein the channel is symmetric with respect to a longitudinal axis therethrough, and valve extending through the channel is symmetric with respect to the longitudinal axis, wherein the valve extending through the channel is sized to establish the gap of about 0.025 inches around the circumference of the valve extending through the channel.

23. The method of claim 20, wherein the channel is symmetric with respect to a longitudinal axis through the channel and the valve through the channel is offset with respect to the longitudinal axis, such that one side portion of the valve abuts a wall portion of the channel and an opposite second side portion forms a gap between the second side portion and the valve to allow air flow along the channel between the first chamber and the opening when the valve seat does not block fluid communication.

24. The method of claim 23, wherein the gap is about 0.050 inches.

* * * * *